US005733040A

United States Patent [19]

Zuk et al.

[11] Patent Number: 5,733,040

[45] Date of Patent: Mar. 31, 1998

[54] LATCH ASSEMBLY FOR BARRELS

[75] Inventors: Boris Zuk, Parma; Raymund Singleton, Avon Lake, both of Ohio

[73] Assignee: Singleton Corporation, Cleveland, Ohio

[21] Appl. No.: 670,165

[22] Filed: Jun. 27, 1996

[51] Int. Cl.[6] ..... B01F 15/02; B01F 9/02

[52] U.S. Cl. ..... 366/347; 366/234; 220/347

[58] Field of Search ..... 366/347, 349, 366/220, 188, 150.1, 234; 220/345, 347; 451/326, 327, 328; 204/213; 49/40, 41

[56] References Cited

U.S. PATENT DOCUMENTS

| | | | |
|---|---|---|---|
| 1,523,939 | 1/1925 | Evans | 220/347 |
| 3,861,654 | 1/1975 | Singleton | 366/234 |
| 3,944,189 | 3/1976 | Singleton | 366/220 |
| 4,736,868 | 4/1988 | Carmon, Jr. | 366/347 |
| 4,918,660 | 4/1990 | Perrot | 366/188 |

*Primary Examiner*—Tony G. Soohoo

*Attorney, Agent, or Firm*—Fay, Sharpe, Beall, Fagan, Minnich & McKee

[57] ABSTRACT

A rotatable barrel assembly, generally referred to as a metal finishing barrel, includes a latch assembly that selectively secures or latches the door during a portion of the barrel rotation. In a preferred arrangement, a latch member of the assembly is weighted so that a latch finger prevents movement of the door from its open position. As rotation of the barrel continues, the weighted latch member then pivots to a second position where the door is free to open and allow unloading of the contents of the barrel.

14 Claims, 5 Drawing Sheets

LATCH ASSEMBLY FOR BARRELS

BACKGROUND OF THE INVENTION

The present invention pertains to an apparatus for treating articles of manufacture in a fluid such as a metal finishing barrel used in the electroplating, cleaning, phosphating, rinsing, and other treating operations. More particularly, the invention relates to a latch assembly used for doors and closures on finish containers or barrels of the automated type. The invention also finds particular utility in retrofitting existing closure assemblies of the automated type.

Various designs for doors on automated finishing barrels have been suggested and developed over the years. A preferred arrangement is for an automated door opening and closing mechanism so that no manual labor is required. The door must also allow for ease of ingress and egress to an internal cavity defined in the barrel while providing a secure closure so that workpieces are retained within the barrel during the treatment process.

Two automated door closure assemblies for barrels of this type that have met with substantial commercial success are shown and described in U.S. Pat. Nos. 3,861,654 and 4,736,868. The disclosures of these two patents are presumed to be well known in the industry but the particular details of their structure and operation are incorporated herein by reference.

Generally, the '654 patent discloses a door that rides along the periphery or circumference of the barrel sidewall between first and second stop members. When the door abuts against the first stop member, a sidewall opening to the interior of the barrel cavity is exposed so that workpieces may be loaded and unloaded therefrom. When the door is driven in the opposite direction, it eventually abuts against the second stop members thereby closing the sidewall opening and allowing the barrel to continue to rotate in that direction so that the contents thereof are tumbled or cascaded. Typically, the barrels are formed of perforated stainless steel to allow a solution to pass through the barrel sidewall as required for treatment of the workpieces.

In the '868 patent, the door travels not only through an arcuate or circumferential path, but also undergoes a radial movement to securely seat within the sidewall opening. In a preferred arrangement, a cam track and cam follower assembly are associated with the door to effect this combined arcuate and radial movement. Moreover, push members extending from a gear cooperate with end plates associated with the door. Preferably, the push members are received in grooves formed in the end plates to effect movement of the door in response to rotation of the gear.

Under limited, particular operating conditions, the load (workpieces) in the barrel can create an out-of-balance situation in which the door is inadvertently opened. For example, the barrel assembly described in the '654 patent is adapted for free-wheeling rotation about support hubs extending from a support structure. Controlled rotation of the barrel results from abutment of the door with the stop members. Potentially, an out-of-balance situation occurs where the workpiece load in the barrel urges the barrel to rotate more quickly than the driving force of the door. Since the barrel rotates more quickly than the door, this can result in a door "open" arrangement for a portion of the rotational cycle. Clearly, this situation is undesirable.

Likewise, an out-of-balance situation in a barrel assembly as described in the '868 patent could cause the push members to become dislodged from the grooves in the door and plates. Potentially, this could allow a limited door "open" arrangement to occur.

The present invention provides a barrel assembly that overcomes this problem by providing a latch assembly that prevents the door from inadvertently opening. According to the preferred arrangement, the latch assembly is operative through only a portion of the rotation. The latch assembly operates automatically to latch the door to the barrel during one portion of barrel rotation and unlatch the door during a second portion of barrel rotation.

SUMMARY OF THE INVENTION

According to the present invention, a simplified and automated latch assembly for an automatic door assembly is provided for a finishing barrel.

Accordingly to the invention, a generally cylindrical barrel has an opening formed in a sidewall thereof through which workpieces are loaded and unloaded. A door is operatively associated with the barrel for selectively covering the opening. A weighted latch assembly engages the door during only a selected portion of the barrel rotation.

According to another aspect of the invention, the latch assembly is operative through approximately 180° of barrel rotation.

According to another aspect of the invention, the latch assembly pivots about a pin so that a latch finger on one side of the pin selectively engages the door. A weight provided on the opposite side of the pin moves the latching finger to and from a latched position as the barrel rotates about a horizontal axis.

A principal advantage of the subject invention is the ability to automatically latch the door to the barrel through a portion of the barrel rotation.

Another advantage of the invention resides in the ability to adjust the portion of barrel rotation through which the latch assembly is operative.

Still another advantage of the invention resides in the ease with which existing barrels may be retrofitted with the latch assembly.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein.

DETAILED DESCRIPTION OF THE PREFERRED EMBODIMENT

Figure 1:
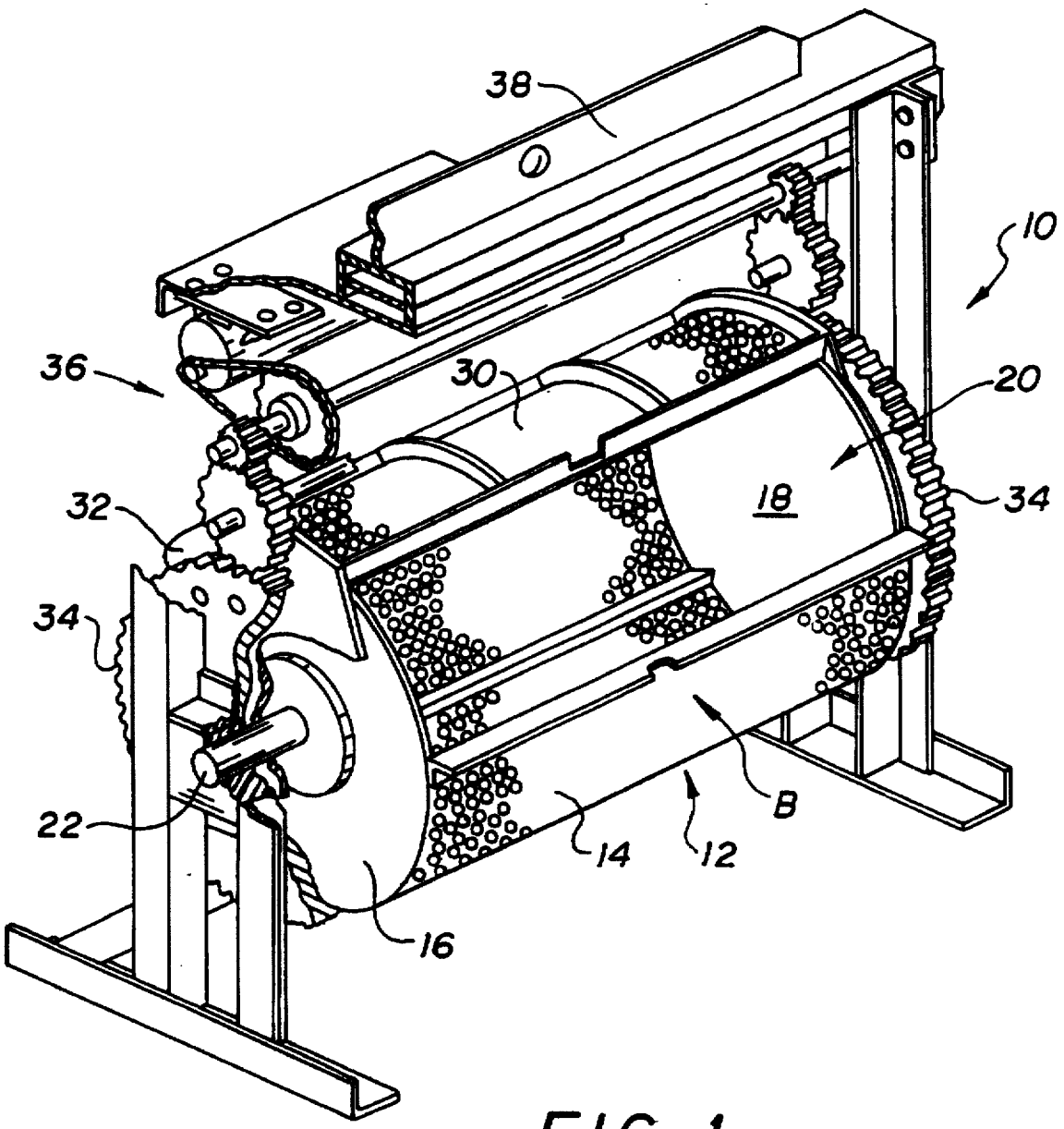
FIG. 1 is a perspective view of a preferred type of automated barrel incorporating the subject latch assembly.

Referring now to the drawings wherein the showings are for the purposes of illustrating the preferred embodiments of the invention only and not for purposes of limiting same, the invention shows a metal finishing barrel assembly A having a latch assembly B operative through a portion of the full rotation of the barrel. More particularly, FIG. 1 shows one preferred arrangement of metal finishing barrel assembly 10 that includes a barrel 12 defined by a generally cylindrical sidewall 14 closed at opposite ends by end walls 16, 18. As briefly described above, the barrel is usually constructed from a perforated or foraminous stainless steel material that can withstand the harsh environment of the treatment process yet allow the treating fluid to pass through the sidewall. An opening 20 is formed in the sidewall to allow access to an internal cavity. That is, the opening allows workpieces to be loaded into the cavity or emptied from the barrel once the treatment process is completed. Hubs 22 located at each end permit the barrel to freely rotate about a longitudinal, horizontal axis.

A door 30 is selectively opened and closed relative to the opening 20. More specifically, the door 30 includes a pair of end plates 32, one at each end, that are non-rotatably secured to an enlarged gear 34. The gear is selectively driven in opposite directions by a drive assembly generally referenced by numeral 36. A frame assembly 38 supports the drive structure and the hubs 22 of the barrel to allow selective rotation of the barrel about its horizontal axis.

Figure 2:
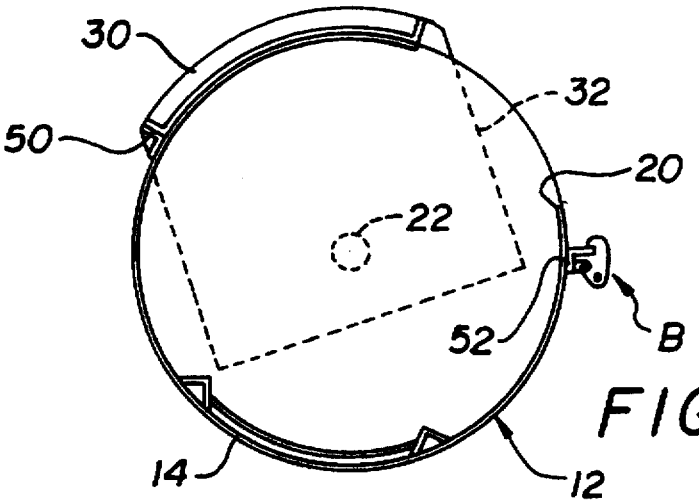
FIG. 2 is a diagrammatic view of the barrel shown in a door open position.
Figure 3:
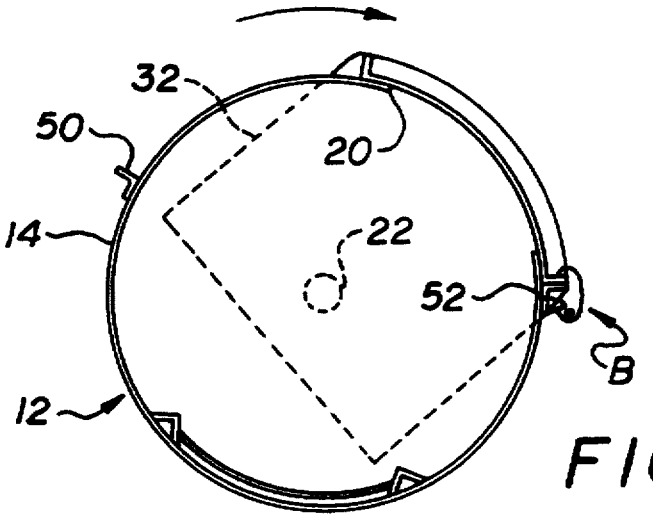
FIG. 3 is a diagrammatic view similar to FIG. 2 after the door has been rotated to a closed position.
Figure 4:
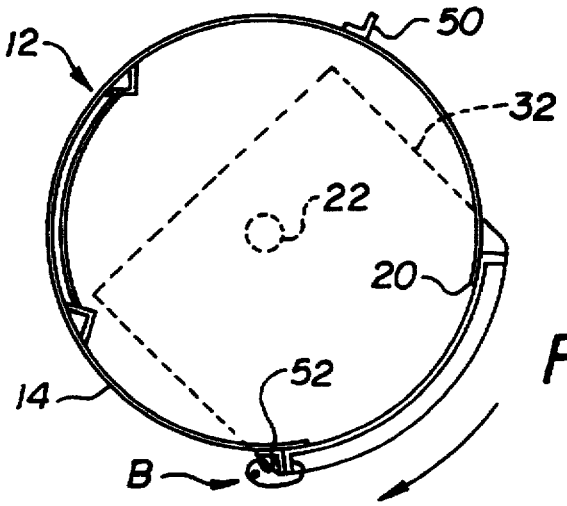
FIG. 4 is a diagrammatic view showing the barrel orientation through a portion of the rotation.

More specifically, and with reference to FIGS. 2–4, rotation of the gear 34 rotates the door relative to the barrel until the door engages one of a pair of stop members. For example, as shown in FIG. 2, the door engages a first stop member 50. In this position, the door is spaced from the opening 20 so that workpieces can be loaded and unloaded from the internal cavity. Continued counterclockwise rotation of the barrel from the position shown in FIG. 2 advances the door, due to abutment against the first stop member 50, to a position where the opening faces downwardly and automatically dumps the contents or workpieces therefrom (not shown). Rotation of the door in the opposite direction, or clockwise, from that depicted in FIG. 2, proceeds to drive door relative to the barrel in a clockwise direction until it abuts against the second stop member 52 (FIG. 3). Once the door abuts against the second stop member, the opening 20 is completely covered by the door. Continued rotation of the door in that direction simultaneously drives both the door and the barrel in a clockwise direction as represented in FIG. 4. This allows the workpieces contained in the barrel to be tumbled or cascaded as desired for the treatment process.

Figure 5:
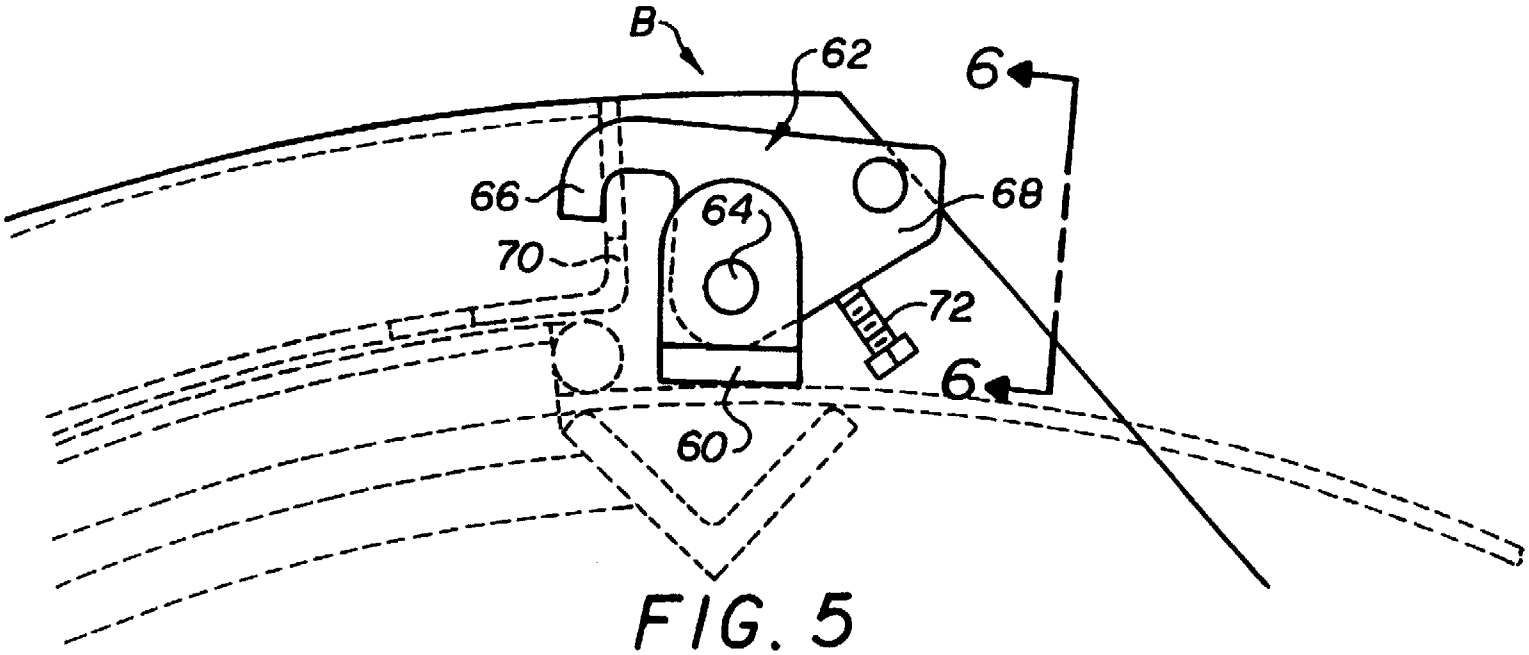
FIG. 5 is an enlarged elevational view of the latch assembly.
Figure 6:
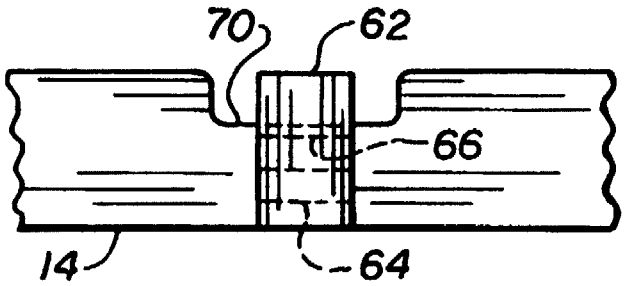
FIG. 6 is an elevational view taken generally along the line 6—6 of FIG. 5.
Figure 7:
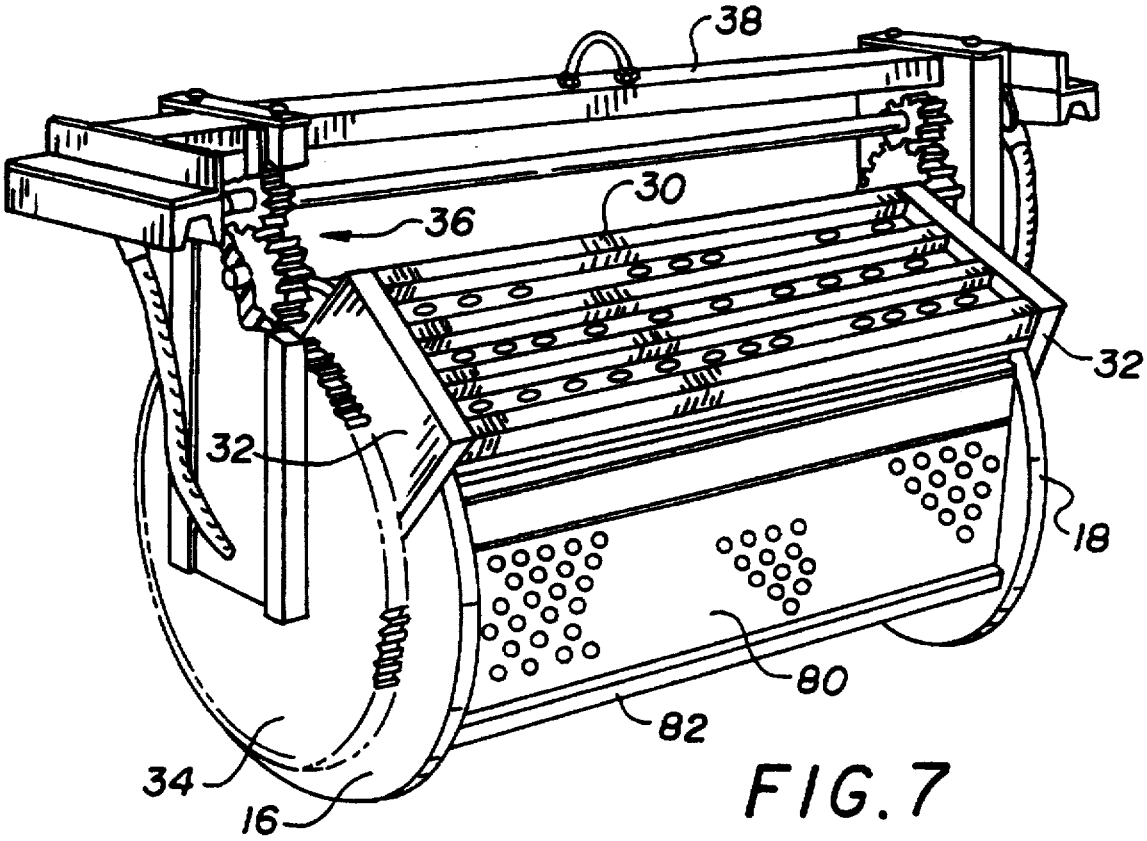
FIG. 7 is a perspective view of a second preferred type of automated barrel incorporating the subject latch assembly.

Occasionally the load imposed by the workpieces can cause the barrel to rotate faster than the door whereby the door can be partially opened and potentially workpieces can empty through the opening. With the subject invention, however, the door is automatically latched through a portion of its rotation (the lower half of rotation) by the latch assembly shown in greater detail in FIG. 5. The latch assembly includes a support bracket 60 secured to the barrel sidewall. A latch member 62 is received for pivoting rotation about a pin 64 which is oriented along a horizontal axis for reasons which will become more apparent below. A latch finger is situated-on one side of the pin 64 and an enlarged counterweight member 68 is defined on the opposite side of the pivot axis. Thus, since the pin 64 is disposed in a horizontal direction, the latch member 62 is positioned as shown in solid line through the upper half or approximately 180° rotation of the barrel since the weight of member 68 is greater than the latch finger. Once the latch member is positioned in the lower portion of the barrel rotation, the weighted member 68 pivots the latch member about the pin 64 and positions the latch finger 66 in engagement with a lip 70 on the door (broken line showing of FIG. 5). This assures that the door remains latched in place during the lower portion of the barrel rotation where it is particularly important that the door remained in a closed position over the opening. Further rotation of the barrel advances the latch assembly to a position where the weight again pivots the latch member 62 about its axis to the release position shown in solid line in FIG. 5. It is understood that the latch assembly could alternately be attached to the door and selectively engage a lip or flange on the barrel, for example, at the second stop member 52.

If desired, an adjustment member such as threaded screw 72, can be provided to limit pivotal movement of the latch member. Moreover, as will be apparent, the timing of the actuation of the latching assembly can be varied by altering the weight or location of the weighted member 68 of the latch assembly. This will determine when an out-of-balance situation occurs causing the latch member to pivot about its axis 64 between latched and unlatched positions.

FIGS. 7–11 illustrate a second preferred embodiment of an automated door for a metal finishing barrel. Where possible, like elements are referred to by like numerals for ease of understanding, while new numerals refer to new elements. The foraminous barrel sidewall in this embodiment may be formed of individual panels 80 that are interconnected along seams 82. Each panel is preferably a polymer or plastic material that is resistant to any deleterious effects of the treating material. If necessary, metal strengthening members can be embedded in the plastic sidewall and seam elements. The end members 16, 18 and sidewall define an enclosed internal cavity which is selectively accessed through opening 20. In this arrangement, the door 30 is adapted for both circumferential and radial movement. To achieve this movement, a cam track 84 is provided on the interior face of each gear 34. The cam track receives a cam member or roller 86 (FIG. 8) that provides for limited relative movement between the door and the gear. This is contrasted to the FIG. 1 embodiment where the gear is non-rotatably secured to the door end plates. Enlarged openings 88 in each end plate also permit the radial movement while push members 90, 92 cooperate with grooves 94, 96 in each end plate.

Figure 9:
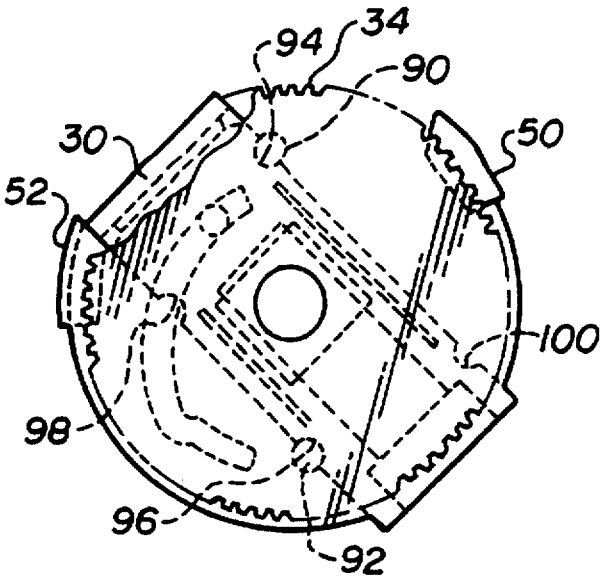
FIG. 9 is an end elevational view of the barrel assembly of FIG. 7 with the door in a closed position.

Thus as illustrated in FIG. 9, the abutment of the push members 90, 92 with the associated grooves 94, 96 retains the door in a closed position over the opening. Relative movement between the gear and the end plates advances the door radially outward as best illustrated by comparing FIGS. 9 and 10. The cam roller 86 is positioned in a new location in the cam track and eventually the push members 90, 92 are received in grooves 94, 96 to engage the end plates and begin circumferential movement of the door relative to the remainder of the barrel. This advances the door toward the first stop member 50 (representing an open position) and away from the second stop member 52.

Figure 8:
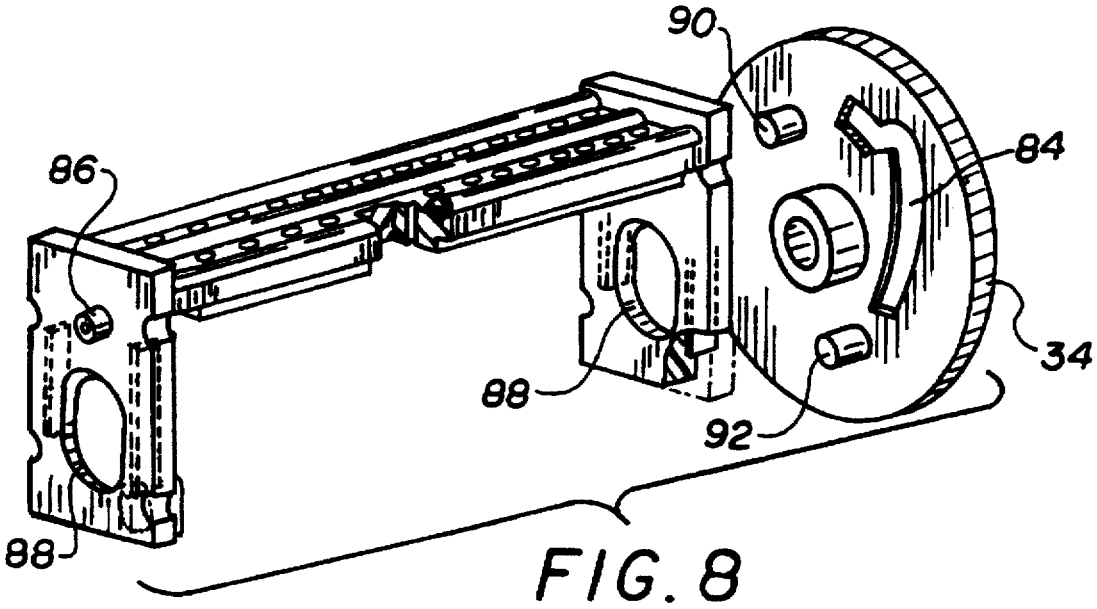
FIG. 8 is a perspective view of a door used in the barrel assembly of FIG. 7.
Figure 11:
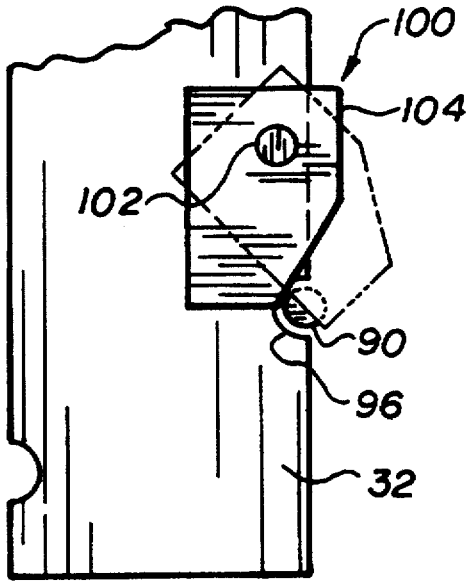
FIG. 11 shows a door end plate with the latch detail shown in actuated and non-actuated positions.
Figure 10:
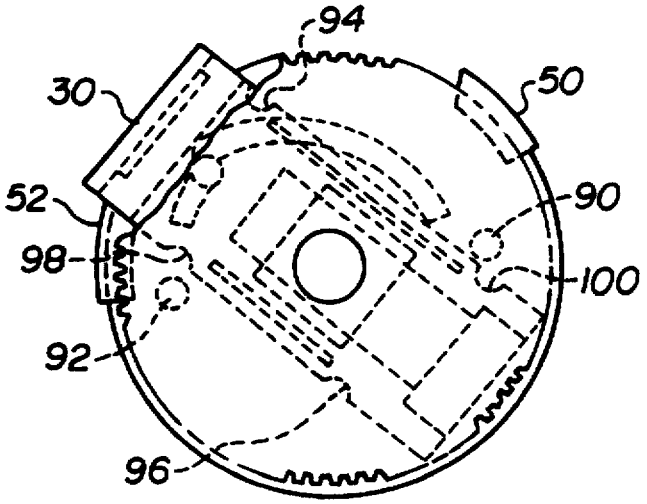
FIG. 10 is an end elevational view of the barrel assembly of FIG. 7 as the door is actuated toward an open position.
Figure 12:
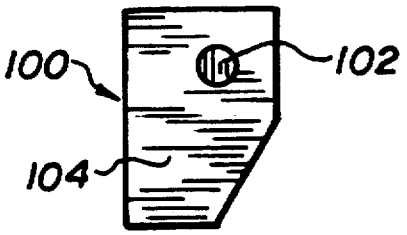
FIG. 12 is a detailed view of the latch assembly used with the embodiment of FIG. 7.

As best illustrated with reference to FIGS. 8 and 11, the latch assembly 100 for this embodiment of the automated metal finishing barrel includes a pivoting latch member that prevents the push members 90, 92 from prematurely leaving the respective grooves 94, 96. By locating pivot pin 102 in a desired position in latch member 104, the weighting of the latch member permits it to swing between latched and unlatched positions. In the latched position, the latch member 104 interferes or engages the push members 90 or 92 and prevents movement of the push members from the recesses 94, 96. Once the barrel has rotated through a portion of its cycle, the latch member pivots back to the position shown in full lines in FIG. 11. In that orientation, the push members are free to leave the recesses and the latch member does not interfere with their movement.

As will be understood, therefore, a premature or unintended opening of the door relative to the barrel opening can be precluded with use of the weighted latch member. Moreover, in either embodiment described above, existing barrels can be easily retrofitted with this arrangement. In the embodiment of FIGS. 1–7, the latch assembly can be secured to existing barrels for selective latching with the door lip. Some modification may be required to the door lip to accommodate the latch finger, but that is believed to be within the scope of the subject invention. The embodiment of FIGS. 7–11 can also be easily retrofitted onto existing barrels. The weighted latch member is easily secured via the pivot pin to the end plates to selectively interfere with and preclude radial movement of the door relative to the opening.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A rotatable barrel assembly used for surface treatment of workpieces comprising:

a generally cylindrical barrel adapted for rotation about an axis;

an opening defined through a sidewall of the barrel through which workpieces may be loaded and unloaded;

a door that moves relative to the barrel for selective covering relation with the opening; and a weighted latch assembly that engages the door to the sidewall during only a selected portion of the barrel rotation to preclude door separation from the opening.

2. The barrel assembly as defined in claim 1 wherein the latch assembly includes a pin about which a latch pivots relative to the barrel.

3. The barrel assembly as defined in claim 1 wherein the latch assembly is operative through approximately 180 degrees of barrel rotation.

4. The barrel assembly as defined in claim 1 wherein the door rotates relative to the barrel.

5. The barrel assembly as defined in claim 4 wherein the door is adapted for arcuate movement along the periphery of the sidewall and the latch assembly selectively prevents the door from moving along an arcuate path during a portion of barrel rotation.

6. The barrel assembly as defined in claim 5 wherein the latch assembly includes a latch finger on one of the door and sidewall and lip on the other of the door and sidewall.

7. The barrel assembly as defined in claim 5 wherein the door includes means for moving the door in a substantially radial path into the opening to fully seat the door after the arcuate movement, the latch assembly including a weighted member that precludes radial movement of the door during only a portion of the barrel rotation.

8. The barrel assembly as defined in claim 7 wherein the door includes end plates at opposite ends thereof, the latch assembly being pivotally mounted to the end plates to preclude movement of the end plates in a radial direction during only a portion of the barrel rotation.

9. A barrel assembly used for surface treatment of workpieces, the barrel assembly comprising:

a barrel having a sidewall that extends between a pair of end walls and includes an opening through a portion thereof for loading and unloading workpieces into the barrel;

a door mounted on the barrel for movement along a generally arcuate path for selectively covering and uncovering the opening; and a latch assembly operatively associated with the door for precluding movement of the door from its covering position over the opening during only a portion of the barrel rotation.

10. The barrel assembly as defined in claim 9 wherein the latch assembly includes a latch that is mounted for rotation about a horizontal axis and being weighted for movement between latched and unlatched positions depending on the rotational position of the barrel.

11. The barrel assembly as defined in claim 10 wherein the latch assembly includes a finger mounted on one of the door and sidewall and a lip mounted on the other of the door and sidewall that the finger engages in the door closed position.

12. The barrel assembly as defined in claim 11 wherein the latch assembly is weighted for positioning the finger in the door closed position through approximately 180 degrees of barrel rotation.

13. The barrel assembly as defined in claim 12 further comprising means for radially moving the door after its arcuate movement to seat the door in the sidewall opening, the latch assembly selectively precluding radial movement of the door during only a portion of the barrel rotation.

14. The barrel assembly as defined in claim 12 wherein the latch assembly includes a weighted member pivotally mounted to end plates of the door that preclude push members that drive the door through its radial and arcuate position from moving relative to the door.

* * * * *